US009924771B2

(12) United States Patent
Labey et al.

(10) Patent No.: US 9,924,771 B2
(45) Date of Patent: Mar. 27, 2018

(54) RETRACTABLE FLEXIBLE HANDLE

(71) Applicant: HERMES SELLIER, Paris (FR)

(72) Inventors: Pierre-Yves Labey, Paris (FR); Christine Maquel, Taverny (FR); Satoru Hosoi, Paris (FR); Sebastien Roulois, Breuillet (FR)

(73) Assignee: HERMES SELLIER, Paris (FR)

( * ) Notice: Subject to any disclaimer, the term of this patent is extended or adjusted under 35 U.S.C. 154(b) by 622 days.

(21) Appl. No.: 14/322,071

(22) Filed: Jul. 2, 2014

(65) Prior Publication Data

US 2015/0013860 A1 Jan. 15, 2015

(30) Foreign Application Priority Data

Jul. 3, 2013 (FR) ..... 13 56498

(51) Int. Cl.
*B65D 25/28* (2006.01)
*A45C 13/26* (2006.01)
*A45C 3/06* (2006.01)

(52) U.S. Cl.
CPC ..... *A45C 13/26* (2013.01); *A45C 3/06* (2013.01)

(58) Field of Classification Search
CPC .. A45C 13/26; A45C 3/00; A45C 3/06; A45C 13/30; A45F 3/02; E05B 1/00; B65D 25/28
USPC ..... 150/108, 100, 107; 16/405, 410, 114.5; 190/115, 116; 312/332.1
See application file for complete search history.

(56) References Cited

U.S. PATENT DOCUMENTS 1,587,982 A * 6/1926 Nover ..... A45C 13/26 150/108
1,958,587 A * 5/1934 Hiscocks ..... A45C 13/26 16/405
2,195,028 A * 3/1940 Finkelstein ..... A45C 13/26 16/405
2,248,328 A * 7/1941 Bechik ..... A47C 31/08 16/444

(Continued)

FOREIGN PATENT DOCUMENTS

FR 850 259 A 12/1939
GB 2 214 490 A 9/1989
GB 2 479 718 A 10/2011

OTHER PUBLICATIONS

FR Search Report, dated Mar. 13, 2014, from corresponding FR application.

*Primary Examiner* — Fenn C Mathew
*Assistant Examiner* — Cynthia Collado
(74) *Attorney, Agent, or Firm* — Young & Thompson

(57) ABSTRACT

A retractable flexible handle includes a support (50) with at least one through slot (60), a flexible grip (20) which passes through the at least one slot (60) with a first portion (21) including at least one strap loop (30) cooperating with at least one guide tab (40) arranged at least partially on a side of an inner face (52) of the support (50), and at least one stop, such that the grip (20) is configured to slide between a carrying position in which the at least one strap loop (30) of the first portion (21) of the grip (20) is in contact with the at least one stop, and a retracted position in which the second portion (22) of the grip (20) substantially hugs the outer face (51) of the support (50). A bag including at least one such handle is also described.

15 Claims, 7 Drawing Sheets

(56) References Cited

U.S. PATENT DOCUMENTS

| | | | | | |
|---|---|---|---|---|---|
| 3,113,651 | A * | 12/1963 | Szabo | A45C 13/22 | 16/405 |
| 3,340,563 | A * | 9/1967 | Parsons | A45C 13/26 | 16/110.1 |
| 4,435,029 | A * | 3/1984 | McKenzie | E05C 19/06 | 312/332.1 |
| 4,825,506 | A | 5/1989 | Weltz | | |
| 7,708,141 | B1 * | 5/2010 | Huang | A45C 3/02 | 206/425 |
| 8,439,174 | B1 * | 5/2013 | Miranda | A45C 5/14 | 190/1 |
| 8,950,638 | B2 * | 2/2015 | Wangercyn, Jr. | H04B 1/385 | 224/217 |
| 2003/0079949 | A1 * | 5/2003 | Harvey | A45C 5/04 | 190/18 A |

* cited by examiner

RETRACTABLE FLEXIBLE HANDLE

FIELD OF THE INVENTION

The present application relates to a retractable handle.

It relates more particularly to a retractable handle for an article of leather goods or luggage. This is for example an article of leather goods of the soft luggage type, for example a bag, in particular a handbag.

BACKGROUND OF THE INVENTION

When an article of leather goods or luggage is used, it is sometimes convenient for at least one handle to be retractable in order to occupy the least possible space, visually and/or physically.

It is moreover desirable for the handle to still be robust enough to support the article and, where necessary, the contents thereof.

This aspect is particularly important for articles made from leather, fabric or similar materials for which a tear is, for example, often irreparable, in particular to the extent that a sewn repair would leave a mark which would not only be unacceptable from an aesthetic point of view, but also, from the point of view of the robustness of the article, would create a local weakness which could more easily result in a new tear.

There are numerous retractable handles in existence, among them the one shown in FIG. 1. This handle 1 comprises a grip 2 suitable for sliding in strap loops, such as the strap loop 4, that are fixed on a support 5. Each end of the grip 2, for example the end 3, is typically shaped like a spearhead, forming a stop when the grip 2 is in a carrying position, i.e. when a user carries the article of which at least one part comprises the support 5. At rest, the grip 2 can adopt a retracted position in which it at least partially hugs a surface of the support 5.

However, such a handle has drawbacks, in particular in terms of robustness and as regards some of the practical aspects thereof.

SUMMARY OF THE INVENTION

The present invention aims to overcome the abovementioned drawbacks at least partially, leading moreover to other advantages.

To this end there is proposed, according to a first aspect, a retractable handle comprising:

- a support comprising an outer face, an inner face and at least one through slot,
- a flexible grip which passes through the at least one slot and comprises a first portion on the side of the inner face of the support and a second portion on the side of the outer face of the support, the first portion of the grip comprising at least one strap loop,
- at least one guide tab arranged at least partially on the side of the inner face of the support and cooperating with the at least one strap loop of the first portion of the grip, and
- at least one stop, the grip being configured to adopt one of at least two positions:

- a carrying position in which the at least one strap loop of the first portion of the grip is in contact with the at least one stop, and
- a retracted position in which the second portion of the grip substantially hugs the outer face of the support, the grip passing from the carrying position to the retracted position by a sliding of the at least one strap loop of the first portion of the grip on the at least one guide tab.

Such a handle is thus suitable for sliding easily while remaining robust. It makes it possible moreover to prevent one end of the grip from curling up at the ends after use.

The presence of a stop makes it possible to form an end of travel for the strap loop, in particular when the grip is in the carrying position. Such a stop is moreover preferably formed on the side of the inner face of the support.

The guide tab is for example fixed to the support by stitching, by a rivet, a stud or adhesive. In the event that the guide tab is stiff, it is possibly fixed by a single one of its ends. In the event that the guide tab is flexible, it is preferably fixed by both of its ends.

According to an embodiment, the at least one stop is formed at least partially by the at least one slot.

According to another embodiment, the at least one stop is formed at least partially by a protrusion of the at least one guide tab, for example in the shape of a bicorne hat. This makes it possible in particular to prevent pulling on the slot, which could risk tearing it, especially if the article for which the handle is intended is very heavy.

According to a particular arrangement, the protrusion of the at least one guide tab is formed close to the at least one slot. This makes it possible to close any gap formed by the slot, and improve the appearance of the handle.

For example, at least one portion of the at least one guide tab, cooperating with the at least one strap loop, is parallel to at least the inner face of the support.

Preferably, at least one of: the grip, the support and the at least one guide tab is made at least partially from leather.

The other end of the handle can be attached to the support by any means. It can be fixed, or configured to slide by any means. If necessary, it is preferably configured to slide by means identical to those previously presented. Thus, according to a beneficial aspect of the invention, there is proposed a retractable handle having all or some of the features previously described, according to which:

- the support comprises the at least one through slot forming a first slot, and a second through slot,
- the flexible grip passes through the first slot on the one hand and the second slot on the other hand and comprises a first portion on the side of the inner face of the support on the near side of the first slot, a second portion on the side of the outer face of the support between the first slot and the second slot and a third portion on the side of the inner face of the support on the near side of the second slot, the first portion of the grip comprising the at least one strap loop forming a first strap loop, and the third portion of the grip comprising at least one strap loop forming a second strap loop,
- the at least one guide tab arranged at least partially on the side of the inner face of the support forming a first guide tab and a second guide tab being arranged at least partially on the side of the inner face of the support, the first guide tab cooperating with the first strap loop of the first portion of the grip, and the second guide tab cooperating with the second strap loop of the third portion of the grip, and
- the at least one stop forming a first stop, and a second stop, the grip being configured to adopt one of the at least two positions:

- the carrying position in which the first strap loop of the first portion of the grip is in contact with the first stop and in which the second strap loop of the third portion of the grip is in contact with the second stop, and the retracted position in which the second portion of the grip substantially hugs the outer face of the support, the grip passing from the carrying position to the retracted position by a sliding of the first strap loop of the first portion of the grip on the first guide tab and of the second strap loop of the third portion of the grip on the second guide tab.

According to another aspect of the present invention, a bag that is at least partially flexible is also proposed, comprising at least one retractable handle having all or some of the features described previously.

According to a particular embodiment, the at least one retractable handle forms a first retractable handle positioned on a first side of an opening allowing access to the contents of the bag, the bag comprising moreover at least one second retractable handle, having all or some of the features described previously, positioned on a second side of the opening.

Advantageously, the first retractable handle and the second retractable handle are each parallel to an edge of the opening. Such a position makes it possible to structure the edges of the opening, in particular so that they remain against each other in order to close the opening when the bag is carried.

According to a preferred embodiment, the bag comprises moreover two additional handles, called the third handle and the fourth handle. This makes it possible to provide a bag with four handles so that it can be carried differently according to need.

The retractable handles then form handles known as inner handles and the additional handles form handles known as outer handles. By "inner" is meant here that the handle is positioned between another handle and the opening of the bag (and not that the handle is situated inside the bag). When the bag is carried by the (inner) retractable handles, the inner handles are thus high handles and the outer handles are low handles.

For example, the first retractable handle is situated between the third handle and the opening and the second retractable handle is situated between the fourth handle and the opening.

Advantageously, the grip of the first retractable handle and the grip of the second retractable handle (in the carrying position) have a length equal to or greater than a length of a grip of the third handle and of a grip of the fourth handle. Thus, in the carrying position, the length of the inner handles allows in particular carrying in the "arm-crook hook" style.

According to a particularly beneficial embodiment, the grip of the first retractable handle and the grip of the second retractable handle adopt the retracted position in a position in which the bag is carried by the third handle and the fourth handle. In this position, the retractable handles thus contribute towards closing the opening for example and do not obstruct carrying of the bag. Furthermore, the fact that the inner handles are retractable responds to an aesthetic concern: the elegance of the top of the bag when it is not held by the inner handles.

BRIEF DESCRIPTION OF THE DRAWINGS

According to an embodiment, the invention will be well understood and its advantages will become more apparent on reading the following detailed description, given indicatively and non-limitatively with reference to the attached drawings, in which.

DETAILED DESCRIPTION OF THE INVENTION

Identical elements shown in FIGS. 1 to 11 are identified by identical numerical references.

It is noted here that FIGS. 2 to 6 show only one end of a retractable handle according to an embodiment of the invention, for example the left end. The other end is for example fixed or retractable using any system. It can in particular be identical to the end described below.

Figure 1:
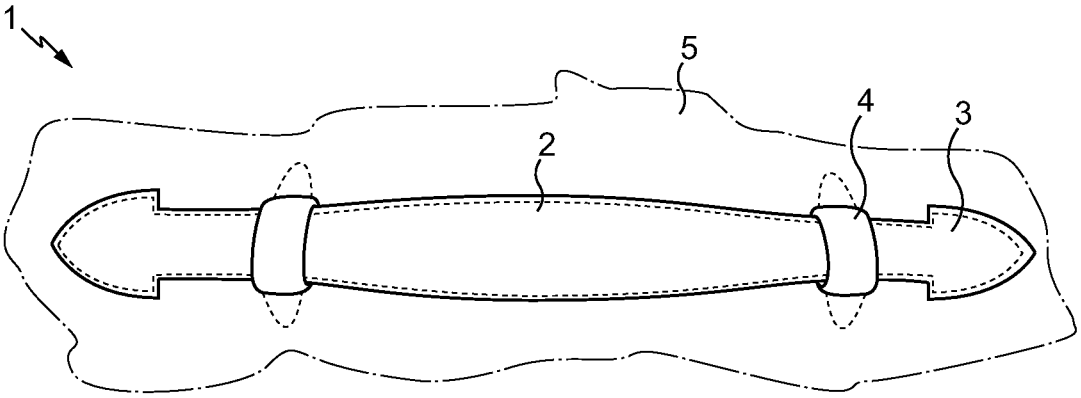
FIG. 1 shows a retractable handle according to the state of the art.
Figure 2:
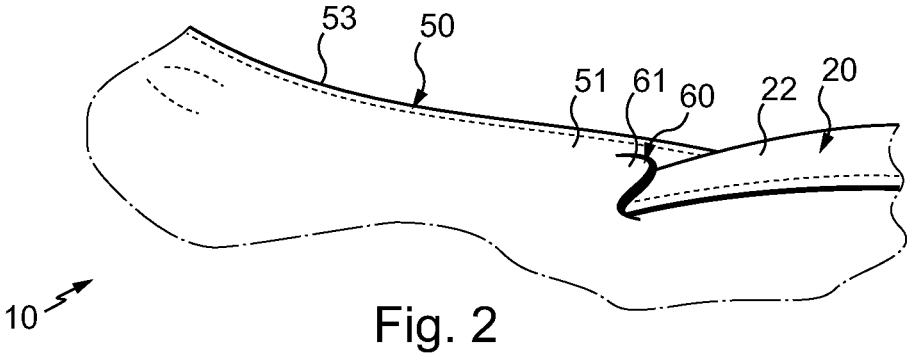
FIG. 2 shows a perspective top view of a retractable handle according to an embodiment of the invention.
Figure 3:
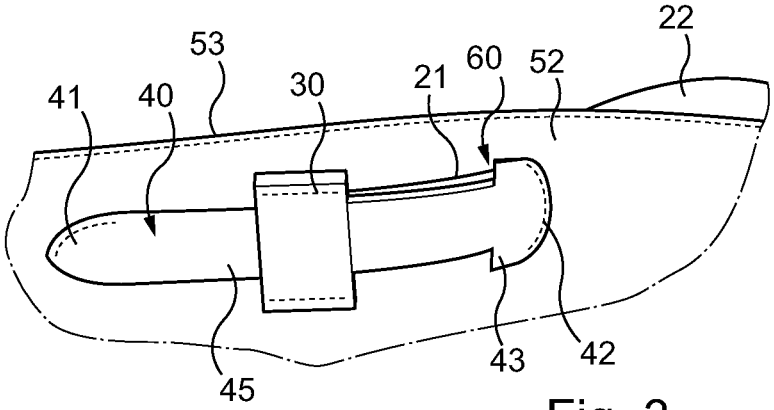
FIG. 3 shows a perspective bottom view of the retractable handle shown in FIG. 2, FIGS. 4*a* to 4*c* show a cross-section view of the sliding action of the retractable handle shown in FIGS. 2 and 3, respectively with the grip in carrying position, in an intermediate position and in a retracted position.

With reference to FIGS. 2 to 4, a retractable handle 10 according to an embodiment of the invention comprises in particular a support 50, a grip 20 and a guide tab 40.

The support 50 comprises an outer face 51, an inner face 52 and a through slot 60 through which the grip 20 passes. The slot 60 has here a half-moon shape, in order to form a tongue 61 covering a portion of the grip 20. It makes it possible to facilitate and guide a sliding of the grip 20 in the slot 60 and to prevent the occurrence of a gap, thus improving the appearance.

The terms "outer" and "inner" are of course used here by convention, according to normal usage, in order to facilitate the following description. The face of the support described as the outer face is thus typically oriented on the side of the article where the portion of the handle intended to be grasped is located, i.e. generally the central portion of the grip.

The grip 20, here flexible, comprises a first portion 21 situated on the side of the inner face 52 of the support 50 and a second portion 22 situated on the side of the outer face 51 of the support 50. The second portion 22 forms, at least partially, the portion of the handle intended to be grasped.

The first portion 21 of the grip 20 comprises a strap loop 30 which here surrounds the guide tab 40. The strap loop 30 is here situated at a free end of the first portion 21 of the grip 20. This makes it possible in particular to save material, to provide the grip 20 with a long travel and/or to prevent any portion of the grip 20 which would extend beyond the strap loop 30 from curling up at the ends or obstructing the sliding of the grip 20. According to the example shown, the strap loop 30 is wider than the first portion 21 of the grip 20. It is moreover, preferably, wider than the slot 60 in order to prevent it from passing through.

According to a particular embodiment, the grip 20 is widened towards a central area with respect to its ends, i.e. typically in its second portion 22. Such widening allows improved ergonomics. This also makes it possible to check the passage of the grip 20 through the slot 60, or even to prevent the grip 20 from being able to pass completely through the slot 60, in particular when the grip is not yet attached by at least one of its ends to another element, such as for example a guide tab.

As shown, the guide tab 40 is here arranged on the side of the inner face 52 of the support 50. In the present embodiment, the guide tab 40 is sewn onto the inner face 52 of the support 50 by its first end 41 and by its second end 42. It is for example produced at least partially from leather, which gives it a certain robustness and flexibility. In another embodiment, not shown, if the guide tab was realized for example by a metal rod, fixing by a single end could be sufficient.

Thus, the guide tab 40 is here substantially parallel to the inner face 52 of the support 50. It is for example pressed against the inner face 52 of the support 50 when the support 50 is taut or laid flat.

The guide tab 40 has at least one portion 45 between its two ends 41 and 42. The width of this portion is constant here and cooperates with the strap loop 30 of the first portion 21 of the grip 20 in order to allow the strap loop 30 to slide freely thereon. According to another embodiment that can be envisaged, not shown, the portion 45 of the guide tab 40 can have an oblong shape (in terms of its width) or a domed shape (in terms of its thickness), substantially widened towards its middle, so as to form a check in order to assist with keeping the grip 20 in the carrying position or in the retracted position. The second end 42 here has a protrusion 43 in the shape of a bicorne hat which acts as a stop to the travel of the strap loop 30 when it slides on the portion 45 of the guide tab 40.

Moreover, the second end 42 is here sewn onto the inner face 52 of the support 50, close to the slot 60, so that the protrusion 43 covers at least partially the slot 60 on the side of the inner face 52. This makes it possible in particular to mask the slot 60 from one side in order to avoid the occurrence of a gap. This is reinforced by the presence of the tongue 61 of the slot 60.

Furthermore, the protrusion 43 is thus situated upstream of the slot 60 with respect to the travel of the strap loop 30 on the guide tab 40, which makes it possible to prevent the strap loop 30 from abutting the slot 60 and pulling thereon, which could damage or tear it. Thus, in the embodiment described here and shown, in particular, in FIG. 3, the portion 45 of the guide tab 40 extends from the protrusion 43 to the first end 41. It is noted that the first end 41 is preferably rounded, ogival or even rectangular with cut-off corners. It can have any other shape.

The retractable handle 10 thus comprises a stop formed here by the protrusion 43. However, it could nevertheless be formed in a different manner, for example by a rim of the slot 60 or by any added element. The stop makes it possible generally to form an end of travel for the strap loop 30 when the grip 20 is in the carrying position. It is preferably formed on the side of the inner face 52 of the support 50.

Optionally, as shown here, the guide tab 40 is positioned parallel to an edge 53 of the support 50. Such an arrangement makes it possible in particular to structure the edge 53.

According to an embodiment of the invention, the grip 20 is configured to adopt at least two positions:

- a carrying position in which the strap loop 30 of the first portion 21 of the grip 20 is in contact with the stop, and
- a retracted position in which the second portion 22 of the grip 20 substantially hugs the outer face 51 of the support 50, the grip 20 passing from the carrying position to the retracted position by a sliding of the strap loop 30 of the first portion 21 of the grip 20 on the guide tab 40. In parallel, a sliding of the grip 20 in the slot 60 then takes place.

Cooperation between the strap loop 30 and the guide tab 40 makes it possible in particular to prevent the end of the handle 20 from curling up at the ends on becoming worn. It is guided (and therefore restrained) by the guide tab 40 which follows (at least via its portion 45) the inner face 52 of the support 50. The portion 45 of the guide tab 40 which follows the inner face 52 of the support 50 preferably has a length equal to or greater than a defined travel of the strap loop between the carrying position and the retracted position of the handle 20.

Figure 4A:
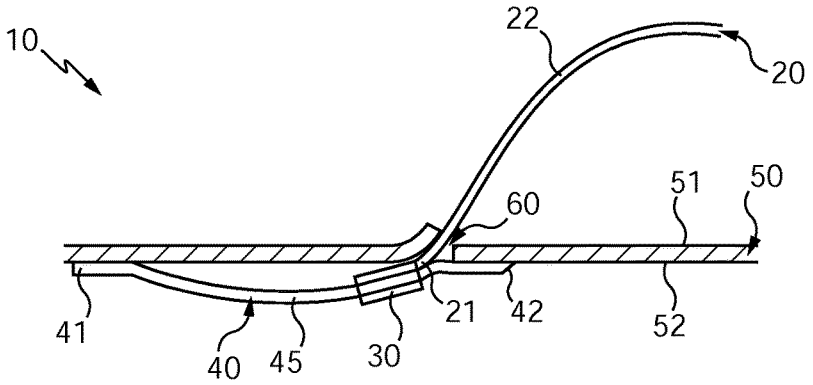
Figure 4B:
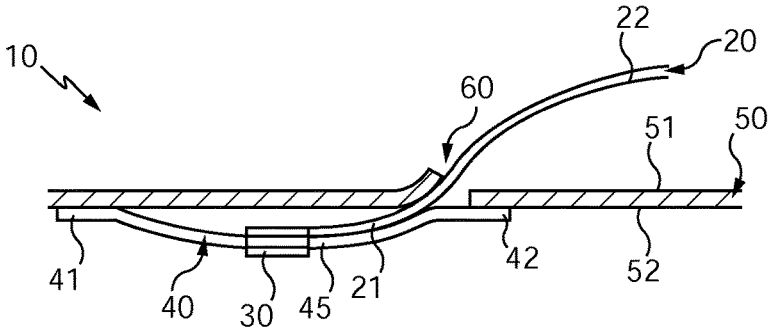
Figure 4C:
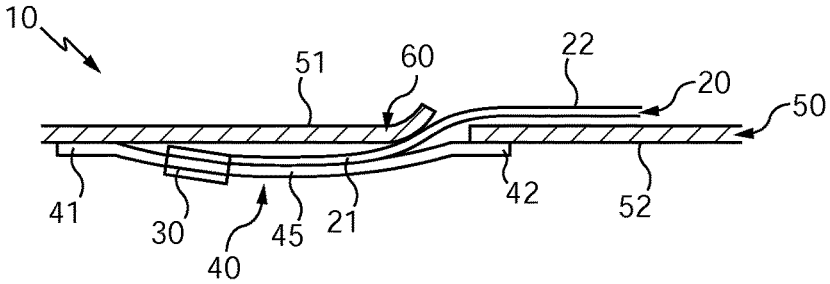

These positions and the passage from one to the other are shown in FIGS. 4*a* to 4*c*.

FIG. 4*a* shows the carrying position. In this position, the strap loop 30 of the first portion 21 of the grip 20 is in contact with the stop which is here formed by the protrusion 43 of the guide tab 40. Such a protrusion 43 is formed at the end 42 of the guide tab 40 and thus makes it possible to prevent pulling on the slot 60 during carrying, which could damage it, for example tear it, if the object to be carried is very heavy.

In this position, the first portion 21 of the grip 20 (i.e. the portion of the grip situated on the side of the inner face of the support 50) is very small, in particular due to the fact that the stop formed by the protrusion 43 is situated in immediate proximity to the slot 60. This makes it possible to arrange the longest possible length of the grip 20 for a user, i.e. so that the second portion 22 of the grip 20 is as long as possible. This also makes it possible to limit the risk of the support 50 being bent under the effect of the weight. Thus, such a protrusion positioned at one end of the guide tab 40 makes it possible to provide the grip 20 with a long travel while contributing to preventing the occurrence of a gap through the slot 60.

FIG. 4*b* shows an intermediate position corresponding to a moment during which the strap loop 30 slides on the guide tab 40, more precisely on the portion 45. This causes, in parallel, a sliding of the grip 20 through the slot 60. As a result, the first portion 21 of the grip 20 becomes longer while the second portion 22 of the grip 20 becomes smaller.

Finally, FIG. 4*c* shows the retracted position of the retractable handle. In this position, the strap loop 30 of the first portion 21 of the grip 20 and the stop, here the protrusion 43, are spaced apart from each other with respect to their configuration in the carrying position. In this position, the second portion 22 of the grip 20 is here laid flat, pressed against the outer face 51 of the support 50 in order to be out of sight as far as possible.

Here, the strap loop 30 is limited in its movement in the retracted position by the length of the grip 20 with respect to the length and the position of the guide tab 40.

According to a particular embodiment, the strap loop 30, in the retracted position, abuts another stop, for example formed by another protrusion which would be formed close to the end 41 of the guide tab 40.

Figure 5:
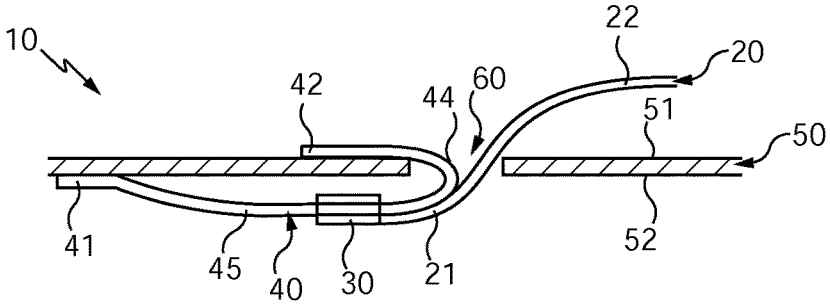
FIG. 5 shows a cross-section view of a second embodiment of the invention.
Figure 6:
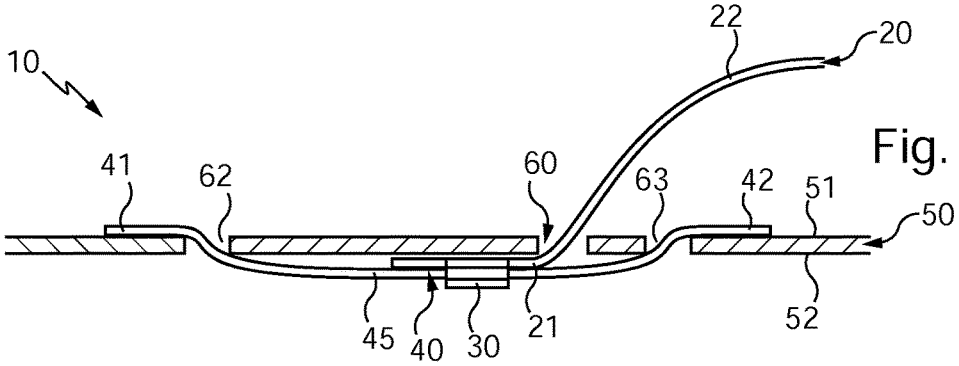
FIG. 6 shows a cross-section view of a third embodiment of the invention.

FIGS. 5 and 6 show other example embodiments of the present invention. In the interests of brevity, the elements in common with the foregoing description will not be described again and are given identical numerical references.

The embodiment in FIG. 5 differs in that the second end 42 of the guide tab 40 is here positioned and fixed, for example sewn, on the outer face 51 of the support 50. Thus, the guide tab 40 passes through the slot 60. The stop is then here formed by a rim of the slot 60 as well as by a fold 44 formed by the guide tab 40. Thus, according to this example, the portion 45 of the guide tab 40, parallel to the inner face 52 of the support 50 and pressed against the inner face 52 of the support 50 when the support 50 is taut or laid flat, is formed by a portion of the guide tab 40 comprised between the first end 41 and the fold 44. The portion 45 of the guide tab 40 has a constant width in the same way as previously and cooperates with the strap loop 30 of the first portion 21 of the grip 20 in order to allow the strap loop 30 to slide thereon. Furthermore, the portion 45 of the guide tab 40 has a length at least equal to the travel of the strap loop 30.

The embodiment in FIG. 6 differs in that the first end 41 and the second end 42 of the guide tab 40 are here positioned and fixed, for example sewn, on the outer face 51 of the support 50. Thus, the first end 41 of the guide tab 40 passes through a second slot 62 and the second end 42 of the guide tab 40 passes through a third slot 63. However, the third slot 63 through which the second end 42 of the guide tab 40 passes can, according to a particular embodiment, be merged with the slot 60.

The stop is here also formed by a rim of the slot 60. The portion 45 of the guide tab 40, parallel to the inner face 52 of the support 50 and pressed against the inner face 52 of the support 50 when the support 50 is taut or laid flat, is, according to this embodiment, formed by a portion of the guide tab 40 which extends from the second slot 62 to at least the slot 60, or even the third slot 63 since the latter is here positioned after the slot 60 in the direction of travel of the strap loop 30 from the retracted position to the carrying position. Thus, the portion 45 of the guide tab 40 has a greater length than the length of travel of the strap loop 30 and advantageously has a constant width in order to allow the strap loop 30 of the first portion 21 of the grip 20 to slide freely thereon.

In a particularly convenient embodiment of the present invention, the other portion of the retractable handle 10, not shown in FIGS. 2 to 6, is similar to the one described previously. The elements are therefore not described here in detail and are mentioned below with the same reference number as for the corresponding previously-described elements, with the additional notation "'".

FIGS. 7 to 11 represent an example of a bag comprising a retractable handle such as the one described previously, with two identical ends. More precisely, it comprises a first retractable handle, referenced 10-1 on a first panel 71-1, and a second retractable handle, referenced 10-2 on a second panel 71-2. The second retractable handle 10-2 is thus visible from an outer face of the panel 71-2 and the first retractable handle 10-1 is visible from an inner face of the first panel 71-1, opposite the second panel 71-2, through an opening 70 of the bag allowing the sliding system to be seen.

According to this embodiment, the bag is largely flexible. By way of illustration, the base can be flexible, stiff, or semi-stiff. It is mainly composed of the first panel 71-1 and of the second panel 71-2, preferably identical, each having an edge 72-1, 72-2 delimiting an opening 70 through which it is possible to access the contents of the bag.

Thus, the first retractable handle 10-1 is positioned on a first side of the opening 70 making it possible to access the contents of the bag and the second retractable handle 10-2 is positioned on a second side of the opening 70.

In the interests of clarity, the elements relating to the first retractable handle 10-1 are denoted by the same numerical references as those used for the description of the elements shown in FIGS. 2 to 6, with the suffix "-1", and the elements relating to the second retractable handle 10-2 are denoted by the same numerical references as previously with the suffix "-2". Hereinafter, when the description applies generically to an element, regardless of the retractable handle to which it belongs, it is referenced without a suffix.

The first panel 71-1 thus forms the support 50-1 of the first retractable handle 10-1. The first panel 71-1 comprises a first slot 60-1, and a second slot 60'-1. The flexible grip 20-1 passes through the first slot 60-1 on the one hand and the second slot 60'-1 on the other hand. It comprises the first portion 21-1 on the side of the inner face 52-1 of the support 50-1 on the near side of the first slot 60-1, the second portion 22-1 on the side of the outer face 51-1 of the support 50-1 between the first slot 60-1 and the second slot 60'-1 and a third portion 21'-1 on the side of the inner face 52-1 of the support 50-1 on the near side of the second slot 60'-1. The first portion 21-1 of the grip 20-1 comprises a first strap loop 30-1 and the second portion 21'-1 of the grip 20-1 comprises a second strap loop 30'-1.

A first guide tab 40-1 and a second guide tab 40'-1 are arranged at least partially on the inner face 52-1 of the support 50-1. The first guide tab 40-1 passes through the first strap loop 30-1 of the first portion 21-1 of the grip 20-1 and the second guide tab 40'-1 passes through the second strap loop 30'-1 of the third portion 21'-1 of the grip 20-1.

As previously, the first retractable handle 10-1 comprises a first stop which is here formed by a protrusion 43-1 of the first guide tab 40-1 as well as a second stop which is here formed by a protrusion 43'-1 of the second guide tab 40'-1.

Thus, the grip 20-1 is configured to adopt either a carrying position or a retracted position. In the carrying position, the first strap loop 30-1 of the first portion 21-1 of the grip 20-1 is in contact with the first stop and the second strap loop 30'-1 of the third portion 21'-1 of the grip 20-1 is in contact with the second stop. In the retracted position, the second portion 22-1 of the grip 20-1 substantially hugs the outer face 51-1 of the support 50-1.

The grip 20-1 then passes from the carrying position to the retracted position by a sliding of the grip 20-1 in the first slot 60-1 and the second slot 60'-1 and a sliding of the first strap loop 30-1 of the first portion 21-1 of the grip 20-1 on the first guide tab 40-1 and of the second strap loop 30'-1 of the third portion 21'-1 of the grip 20-1 on the second guide tab 40'-1.

The first guide tab 40-1 and the second guide tab 40'-1 of the first retractable handle 10-1 are preferably positioned one running on from the other so that the grip 20-1 keeps the same longitudinal axis when it passes from the carrying position to the retracted position. Furthermore, they are advantageously positioned parallel to the edge 72-1 of the panel 71-1, which makes it possible to structure the edge 72-1 of the opening 70.

The second retractable handle 10-2 is here identical to the first retractable handle 10-1 (the description thereof thus applies to the retractable handle 10-2 by replacing the suffix "-1" with the suffix "-2").

Positioning the retractable handles 10 parallel to each of the edges 72 of the opening 70, in particular in the retracted position, makes it possible to structure the edges 72 and thus to contribute towards keeping the opening 70 in the closed position.

In the present embodiment, the bag comprises moreover a third additional handle 100-3 and a fourth additional handle 100-4.

The third additional handle 100-3 comprises a grip 200-3 and the fourth additional handle 100-4 comprises a grip 200-4. The additional handles 100 can be standard handles, for example like the one shown in FIG. 1. However, they can be of any type, in particular conforming to the retractable handle according to embodiments of the invention, and can be similar or different.

Here, each of the additional handles 100 is arranged on a panel 71 so that, on each panel 71, a retractable handle 10 is situated between an additional handle 100 and an edge 72 of the opening 70.

Thus, according to this embodiment, the retractable handles 10 form handles known as inner handles and the additional handles 100 form handles known as outer handles. By "inner", is meant here that the handle is positioned between another handle and the opening of the bag (and not that the handle is situated inside the bag). With reference to the configuration of the bag shown, the inner handles are thus high handles and the outer handles are low handles when the bag is carried by the inner handles.

The length of the outer portion of the grips of the inner handles (in the carrying position) is advantageously greater than the length of the grips of the outer handles, in particular for ergonomic reasons. Thus, the length of the inner handles allows in particular carrying in the "arm-crook hook" style.

The bag shown thus comprises four handles, two inner and two outer. It is configured in this way in order to provide a volume known as a large volume when the bag is carried by the inner handles, and a volume known as a small volume when the bag is carried by the outer handles. The volume of the bag is thus adjustable according to need.

In the case where the bag is very full, requiring a large volume to be available, which often means additional weight, the inner handles (retractable handles 10), which have the ability to withstand greater stresses, can thus be used.

Figure 7:
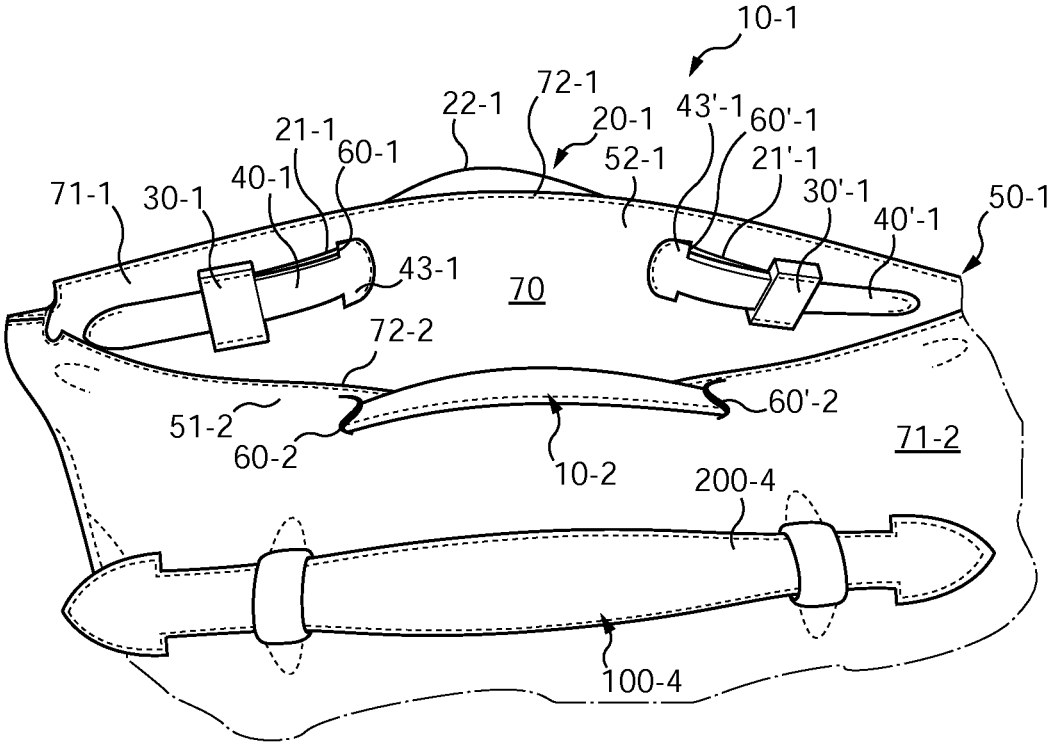
FIG. 7 shows the upper portion of a bag according to an embodiment of the invention, comprising four handles of which two are outer handles and two are inner handles formed by retractable handles according to the embodiment of the invention shown in FIGS. 2 to 4, FIGS. 8 and 9 show a front view of the bag shown in FIG. 7.
Figure 8:
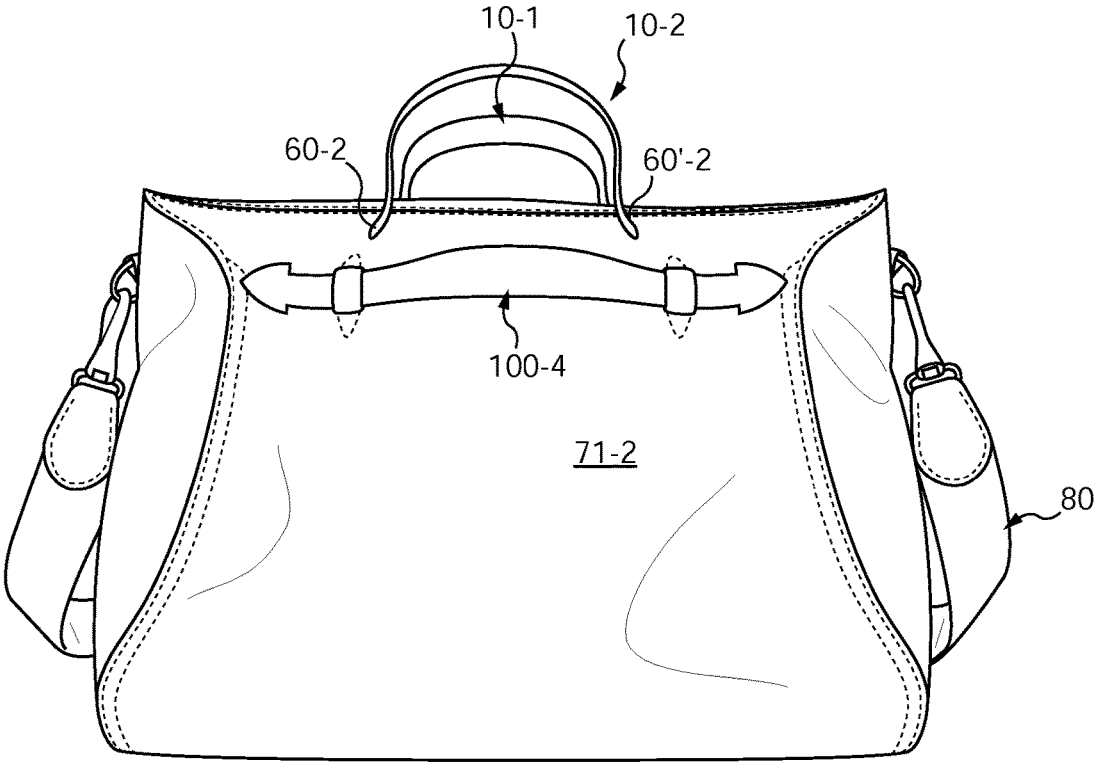
Figure 9:
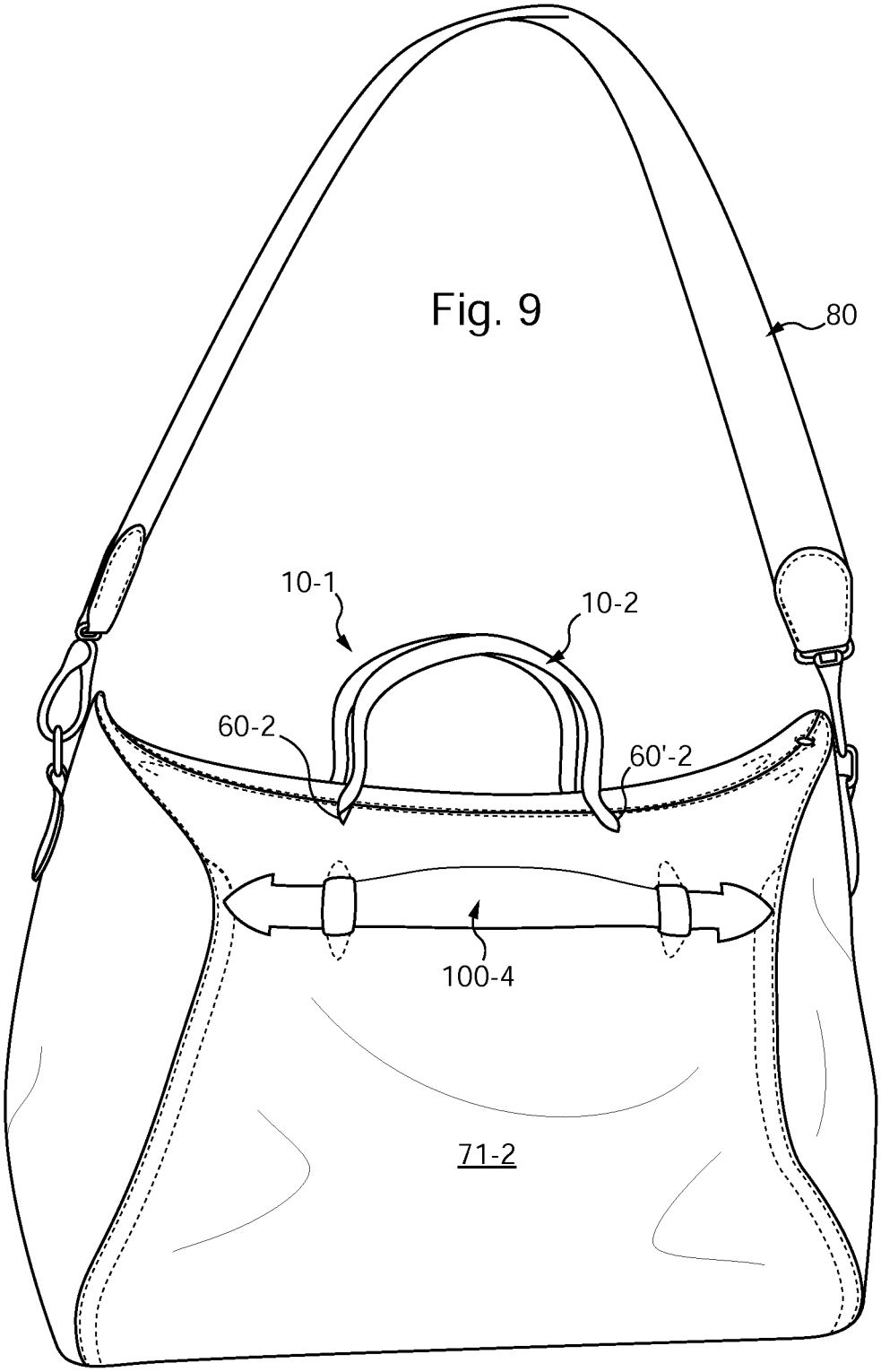

FIGS. 8 and 9 show the bag described with reference to FIG. 7 configured to be carried by the inner handles which are the retractable handles 10 in the carrying position. The additional handles 100 are then preferably retracted in order to protrude as little as possible.

Figure 10:
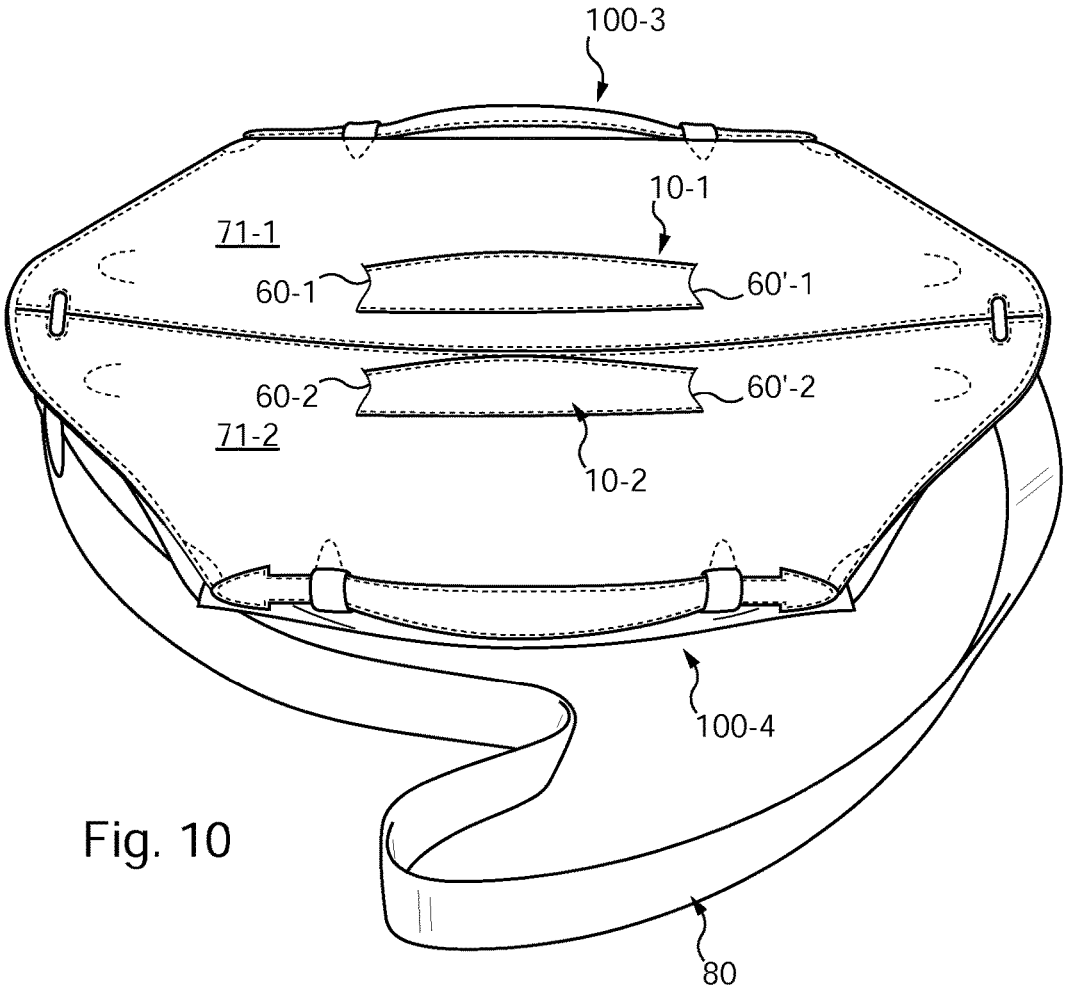
FIG. 10 shows a perspective top view of the bag shown in FIGS. 7 to 9.

FIG. 10 shows the bag described with reference to FIG. 7, in a perspective top view, in an intermediate position between a carrying position using the inner handles, here the retractable handles 10, and a carrying position using the outer handles, here the additional handles 100. In the latter position, the retractable handles 10 are preferably in the retracted position.

Figure 11:
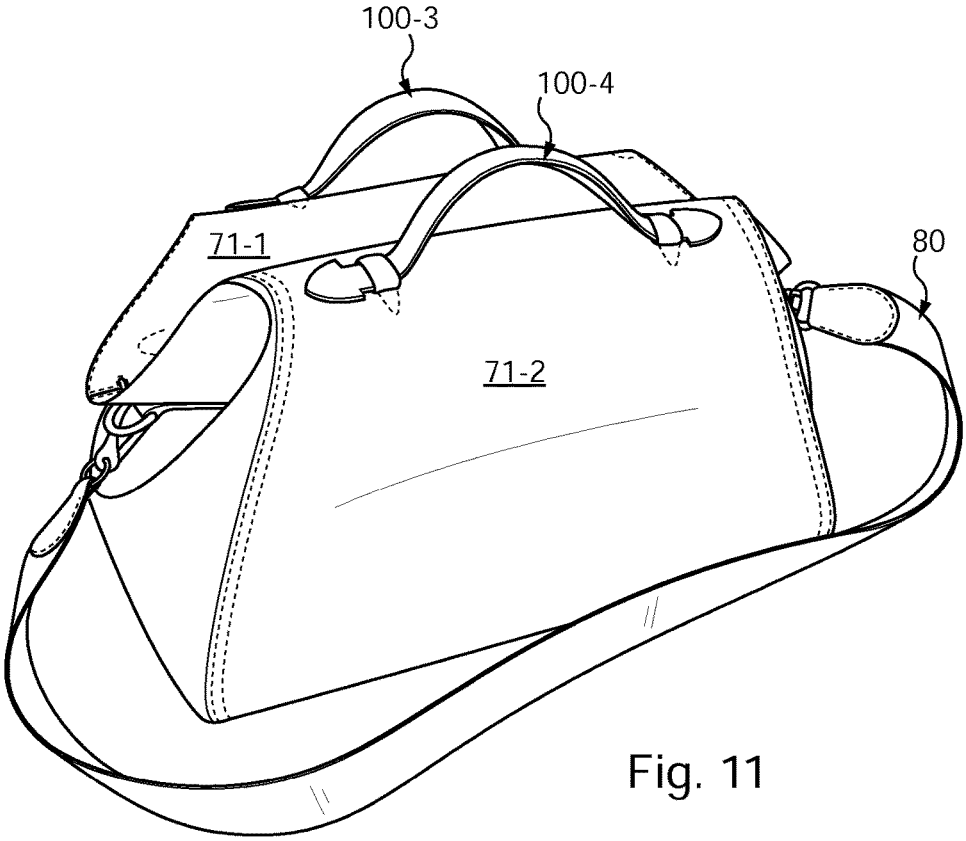
FIG. 11 shows the bag shown in FIGS. 7 to 10 in a carrying position using the outer handles.

FIG. 11 shows the bag described with reference to FIG. 7, in a position for being carried using the outer handles. The inner handles (which are preferably retractable handles 10) are then retracted. In this position of the bag, they contribute moreover towards closing the opening 70 for example and do not obstruct the carrying of the bag. Furthermore, the fact that the inner handles are retractable responds to an aesthetic concern: the elegance of the top of the bag when it is not held by the inner handles.

In this position, the panels 71 of the bag are curved and the outer handles then form a peak.

It is noted here that, although the example previously described refers to inner handles which are retractable handles according to an embodiment of the invention, other types of handles can be used.

According to a particular embodiment, a bag such as described previously is produced at least partially from leather, imitation leather, fabric or any other flexible material or from any assembly of such materials.

Optionally, it comprises moreover a shoulder strap 80 providing another option for carrying the bag.

Of course, the present invention is not limited either to the above description or to the attached figures, but extends to any variant within the scope of a person skilled in the art, in particular, in order to satisfy specific requirements.

The invention claimed is:

1. A retractable handle comprising:

a support comprising an outer face, an inner face, and at least one through slot;

a flexible grip which passes through the at least one slot and comprises a first portion on a side of the inner face of the support and a second portion on a side of the outer face of the support, the first portion of the grip comprising at least one strap loop;

at least one guide tab disposed at least partially on the side of the inner face of the support cooperating with the at least one strap loop of the first portion of the grip, the strap loop surrounding the guide tab; and at least one stop, wherein the grip is configured to adopt one of at least two positions:

a carrying position in which the at least one strap loop of the first portion of the grip is in contact with the at least one stop, and a retracted position in which the second portion of the grip substantially hugs the outer face of the support, and the grip passes from the carrying position to the retracted position by a sliding of the at least one strap loop of the first portion of the grip on the at least one guide tab.

2. The retractable handle according to claim 1, wherein the at least one stop is formed at least partially by the at least one slot.

3. The retractable handle according to claim 1, wherein the at least one stop is formed at least partially by a protrusion of the at least one guide tab.

4. The retractable handle according to claim 3, wherein the protrusion of the at least one guide tab is formed close to the at least one slot.

5. The retractable handle according to claim 1, wherein at least one portion of the at least one guide tab, cooperating with the at least one strap loop, is parallel to at least the inner face of the support.

6. The retractable handle according to claim 1, wherein at least one of: the grip, the support, and the at least one guide tab is made at least partially from leather.

7. The retractable handle according to claim 1, wherein:

the support comprises the at least one through slot forming a first slot, and a second through slot, the flexible grip passes through the first slot and the second slot and comprises a first portion on the side of the inner face of the support on a near side of the first slot, a second portion on the side of the outer face of the support between the first slot and the second slot, and a third portion on the side of the inner face of the support on a near side of the second slot, the first portion of the grip comprising the at least one strap loop forming a first strap loop, and the third portion of the grip comprising at least one strap loop forming a second strap loop, the at least one guide tab is disposed at least partially on the side of the inner face of the support forming a first guide tab and a second guide tab disposed at least partially on the side of the inner face of the support, the first guide tab cooperating with the first strap loop of the first portion of the grip, and the second guide tab cooperating with the second strap loop of the third portion of the grip, and the at least one stop forming a first stop, and a second stop, the grip being configured to adopt one of the at least two positions:

the carrying position in which the first strap loop of the first portion of the grip is in contact with the first stop and in which the second strap loop of the third portion of the grip is in contact with the second stop, and the retracted position in which the second portion of the grip substantially hugs the outer face of the support, and the grip passes from the carrying position to the retracted position by a sliding of the first strap loop of the first portion of the grip on the first guide tab and of the second strap loop of the third portion of the grip on the second guide tab.

8. A bag, comprising:

at least one retractable handle according to claim 1, wherein the bag is at least partially flexible.

9. The bag according to claim 8, wherein the at least one retractable handle forms a first retractable handle positioned on a first side of an opening allowing access to the contents of the bag, the bag further comprising at least one second retractable handle, positioned on a second side of the opening.

10. The bag according to claim 9, wherein the first retractable handle and the second retractable handle are each parallel to an edge of the opening.

11. The bag according to claim 9, further comprising two additional handles that are a third handle and a fourth handle.

12. The bag according to claim 11, wherein the first retractable handle is situated between the third handle and the opening, and wherein the second retractable handle is situated between the fourth handle and the opening.

13. The bag according to claim 12, wherein the grip of the first retractable handle and the grip of the second retractable handle have a length equal to or greater than a length of a grip of the third handle and of a grip of the fourth handle.

14. The bag according to claim 12, wherein the grip of the first retractable handle and the grip of the second retractable handle adopt the retracted position when the bag is carried using the third handle and the fourth handle.

15. The bag according to claim 8, further comprising two additional handles that are a third handle and a fourth handle.

* * * * *